US009427742B2

(12) United States Patent
Yanase

(10) Patent No.: US 9,427,742 B2
(45) Date of Patent: Aug. 30, 2016

(54) MILL

(71) Applicant: Daito Doboku, Ltd., Kisarazu, Chiba (JP)

(72) Inventor: Shigeo Yanase, Kisarazu (JP)

(73) Assignee: DAITO DOBOKU, LTD. (JP)

( * ) Notice: Subject to any disclaimer, the term of this patent is extended or adjusted under 35 U.S.C. 154(b) by 465 days.

(21) Appl. No.: 13/973,133

(22) Filed: Aug. 22, 2013

(65) Prior Publication Data

US 2014/0008473 A1 Jan. 9, 2014

Related U.S. Application Data

(63) Continuation-in-part of application No. PCT/JP2011/067554, filed on Jul. 29, 2011.

(30) Foreign Application Priority Data

Mar. 31, 2011 (WO) ..... PCT/JP2011/058296

(51) Int. Cl.

| | |
|---|---|
| ***B02C 17/00*** | (2006.01) |
| ***B02C 17/18*** | (2006.01) |
| ***B02C 17/07*** | (2006.01) |

(Continued)

(52) U.S. Cl.

CPC ..... *B02C 17/18* (2013.01); *B02C 17/06* (2013.01); *B02C 17/07* (2013.01); *B02C 17/16* (2013.01); *B02C 17/182* (2013.01); *B02C 17/22* (2013.01);

(Continued)

(58) Field of Classification Search

CPC ..... B02C 17/07; B02C 17/18; B02C 17/182; B02C 17/16; B02C 17/22

USPC ..... 241/284, 299

See application file for complete search history.

(56) References Cited

U.S. PATENT DOCUMENTS 3,233,835 A * 2/1966 Sevin ..... B01F 5/0683 241/171

3,404,846 A * 10/1968 MacPherson ..... B02C 17/04 241/153

(Continued)

FOREIGN PATENT DOCUMENTS

| | | |
|---|---|---|
| JP | 61-071846 | 4/1986 |
| JP | 04-066132 | 3/1992 |

(Continued)

OTHER PUBLICATIONS

International Search Report, PCT/JP2011/067554, date of mailing Oct. 18, 2011.

*Primary Examiner* — Faye Francis

(74) *Attorney, Agent, or Firm* — Andrus Intellecutal Property Law, LLP

(57) ABSTRACT

To provide a mill that can greatly reduce noise during operation and can also contribute to greater device compactness. The mill is provided with: a tubular drum body configured in a manner so that a material to be milled introduced from one section can be discharged from another section; a central shaft that penetrates within the drum body in the direction of tube length thereof; and a plurality of milling plates that are attached at a predetermined interval in the axial direction of the central shaft, and that compartmentalize the interior space of the drum body in to a plurality of milling chambers. The drum body and/or the milling plates rotate, and the mill does not have a milling medium that mills the material to be milled by contacting the material to be milled while rolling within the drum body.

10 Claims, 19 Drawing Sheets

(51) Int. Cl.

| | |
|---|---|
| ***B02C 17/06*** | (2006.01) |
| ***B02C 17/22*** | (2006.01) |
| ***E01C 19/05*** | (2006.01) |
| ***B02C 17/16*** | (2006.01) |

(52) U.S. Cl.
CPC ..... *E01C 19/05* (2013.01); *B02C 2017/165* (2013.01)

(56) References Cited

U.S. PATENT DOCUMENTS 3,441,226 A * 4/1969 Bargero ..... B02C 17/06 241/153
3,459,380 A * 8/1969 Kartman ..... B02C 17/06 241/21
3,869,091 A * 3/1975 Enkegaard ..... B02C 17/225 241/183
4,078,730 A * 3/1978 Hansen ..... B02C 17/06 241/54
4,498,634 A * 2/1985 Nelson ..... B02C 17/06 241/179
4,518,500 A * 5/1985 Virea ..... B02C 17/06 210/380.3
4,917,312 A * 4/1990 Bogdanov ..... B02C 17/06 241/179
4,923,127 A * 5/1990 Bogdanov ..... B02C 17/06 241/176
4,949,907 A * 8/1990 Bogdanov ..... B02C 17/06 241/153
5,174,512 A * 12/1992 Orlandi ..... B02C 17/06 241/153
5,251,830 A * 10/1993 Jiang ..... B02C 17/06 241/153
5,413,288 A * 5/1995 Inui ..... B02C 17/06 209/400
7,073,737 B2 * 7/2006 Schulte ..... B02C 17/06 241/30
2003/0006329 A1 * 1/2003 Yanase ..... B02C 17/163 241/172

FOREIGN PATENT DOCUMENTS

| | | |
|---|---|---|
| JP | 2003-073153 | 3/2003 |
| JP | 2003-190827 | 7/2003 |
| JP | 2006-205118 | 8/2006 |
| JP | 2008-104910 | 5/2008 |
| JP | 2010-125446 | 6/2010 |
| WO | 2012-131998 | 10/2012 |

* cited by examiner (a)

(b)

MILL

CROSS-REFERENCE TO RELATED APPLICATIONS

The present application is a continuation-in-part of International Application PCT/JP2011/067554, filed Jul. 29, 2011, which international application was published on Oct. 4, 2012 as international Publication WO 2012/132041. The International Application claims priority of International Patent Application No. PCT/JP2011/058296, filed Mar. 31, 2011, which international application was published on Oct. 4, 2012, as International Publication WO 2012/131998.

TECHNICAL FIELD

The present invention relates to a mill for milling aggregates etc. and in particular, relates to a mill that can reduce noise and the like.

BACKGROUND

Conventionally, there have been various kinds of ball mill-type mills as a device for obtaining recycled aggregate from scrap materials of concrete or asphalt. Many of them have dram bodies whose internal portions are divided by several milling plates (divider plates) in order to extend residence time of a to-be-milled material(s). In such mills, the to-be-milled material are moved from one end to the other end of the drum both through a gap between peripheral edge parts of the milling plates and walls inside the drum body as they are milled by a ball (a milling media) in each divided section.

This kind of conventional mill was attached such that its milling plate intersected at a right angle to a central shaft, and therefore it made impossible to positively move the ball in a front-back direction (in a shaft length direction of the drum body). As a result, the ball mostly used to move toward a radial direction and a circumferential direction. It therefore caused a ball and a to-be-milled material to rotate at uniform velocity, i.e. so called "an accompanying rotation" phenomenon, leading to significant decrease in mill efficiency.

In order to solve these problems, the applicant has already proposed a mill that can remarkably improve the mill efficiency by preventing the above-described accompanying rotation phenomenon from generating (see the following patent documents 1 and 2). The inventions described in the patent documents 1 and 2 can positively move a milling media (a ball etc.) in a front and back direction by attaching a milling plate so that it is inclined with respect to the plane intersecting the central shall, at a right angle. So to speak, they added to the milling plate the function of an agitating blade.

However, the conventional ball-mill type mills including, the mills in the patent documents 1 and 2 had a problem of making a loud noise. After examining, the applicant discovered that the main reason for the loud noise was due to big noise generated by clash between the ball and the to-be-milled material, and the ball and a drum body, especially, the latter.

SUMMARY OF THE INVENTION

Problems to be Solved by the Invention

The present invention is to solve the above-described problems of the conventional art, to be able to remarkably reduce noise during operation, and to contribute to miniaturization of a device.

Means for Solving the Problems

The mill of the present invention comprises a cylindrical drum body configured so that a to-be-milled material(s) can be taken in through a part of the mill and be discharged from the other part, a central shaft penetrating said drum body in a longitudinal direction, and a plurality of milling plates which are attached with predetermined spacing in a shall direction of said central shaft and divide interior space of said drum body into a plurality of milling chambers, wherein at least any one of said drum body or said milling plates rotates, and wherein the mill does not comprise a milling media which mills said to-be-milled material by contacting said material therewith while moving by rolling in said drum body. "At least any one of said drum body or said milling plate rotates" includes a case where only a drum body rotates but a milling plate remains stationary, a case where only the milling plate rotates but the drum body remains stationary, and a case where both the drum body and the milling plate rotate.

The mill according to one aspect of the present invention comprises a plurality of pressure-receiving members which are attached to said drum body and face each of said milling plates, respectively, wherein at least any one of said milling plates and said pressure-receiving members rotates. "At least any one of said milling plates and said pressure-receiving members rotates" includes a case where only a milling plate rotates but a pressure-receiving member remains stationary, a case where only the pressure-receiving member rotates but the milling plate remains stationary, and a case where both the milling plate and the pressure-receiving member rotate.

According to the mill of one aspect of the present invention, at least any one of said milling plate and said pressure-receiving members is inclined with respect to a plane intersecting the central shaft at a right angle.

According to the mill of one aspect of the present invention, said milling plate is provided with a plurality of through holes which said to-be-milled material can pass through.

According to the mill of one aspect of the preset invention, said through holes are provided only in the vicinity of said central shaft.

According to the mill of one aspect of the present invention, said pressure-receiving members are provided with a plurality of through holes which said to-be-milled material can pass through.

According to the mill of one aspect of the present invention, said milling plates and said pressure-receiving members rotate in a reverse direction with respect to each other.

According to the mill of one aspect of the present invention, surface of at least any one of said milling plates and said pressure-receiving members has a concave-convex pattern. "Concave-convex pattern" includes a fine concave-convex pattern whose surface is finely roughened and a large concave-convex pattern having relatively large concave and convex portions.

According to the mill of one aspect of the present invention, said milling plates have wavy curved-surface structures where peaks and valleys are iteratively provided at certain spacing in a circumference direction.

According to the mill of one aspect of the present invention, a hopper for putting the to-be-milled material into said drum body is provided on a central part of the drum body in a longitudinal direction, a discharge spout for discharging the to-be-milled material from said drum body is provided on both ends of the drum body in a longitudinal direction, said milling plates are attached to be inclined with respect to a plane intersecting said central shaft at a right angle and rotate with said central shaft, and said milling plates at one side and the other side across the said hopper are oppositely inclined with respect to each other.

According to the mill of one aspect of the present invention, said milling plates are attached to be inclined with respect to a plane intersecting said central shaft at a right angle and rotate with said central shaft, said pressure-receiving members have an inclined plane which is attached on intersect said central shaft at a right angle and is inclined with respect to a plane intersecting said central shaft at a right angle so that a plane facing said milling plates will be substantially circular truncated cone-shaped, and an inclined angle of said inclined plane with respect to the plane intersecting said central shaft at a right angle is substantially equal to an inclined angle of said milling plates with respect to the plane intersecting said central shaft at a right angle.

According to the mill of one aspect of the present invention, a discharge spout for discharging the to-be-milled material from said drum body is provided with a mechanism for changing discharge spout areas, which can change size of said discharge spout.

The mill according to one aspect of the present invention comprises at least one sieve member which is attached to said other part of said drum body and sorts the to-be-milled material discharged from said drum body into several grades. According to the mill of one aspect of the present invention, a plurality of conveyor devices for carrying the to-be-milled material sorted by the sieve member for every said grade are placed.

Effects of the Invention

According to the present invention, the mill has no milling media, such as a ball, which was conventionally placed inside a drum body, and thus no clash between the milling media and the drum body or to-be-milled materials happens. That is, the to-be-milled materials are mutually rubbed and milled. Therefore, the noise made by the clash of a milling media and a drum body, etc. can be eliminated and the total amount of noise can be reduced. Furthermore, the absence of the milling media can decrease a volume of the drum body by the volume occupied by the milling media.

According to one aspect of the present invention, even if the mill has no milling media, such as a ball, which was conventionally placed inside a drum body, it is possible to efficiently mill the to-be-milled material by rubbing the materials between the milling plate and a pressure-receiving member.

According to one aspect of the present invention, inclination of at least any one of the milling plate and the pressure-receiving member with respect to the plane intersecting the central shaft at a right angle can easily create narrower rooms for holding the to-be-milled material in between the pressure-receiving member and the milling plate, thereby improving the mill efficiency.

According to one aspect of the present invention, a plurality of through holes provided on the milling plate for passing the to-be-milled material therethrough allows to keep the mill efficiency high, make the flow of the to-be-milled material smooth, and improve the working efficiency. According to one aspect of the present invention, the through holes of the milling plate provided only in the vicinity of the central shaft increases residence time of the to-be-milled material in each milling chamber and allows to ensure elimination of foreign matters (such as mortar etc.) adhered on surface of the to-be-milled material (scrap materials of concrete etc.), thereby improving quality of the recycled aggregate to be reclaimed.

According to one aspect of the present invention, a plurality of through holes provided on the pressure-receiving member for passing the to-be-milled material therethrough allows to keep the mill efficiency high, make the flow of the to-be-milled material smooth, and improve the working efficiency.

According to one aspect of the present invention, rotation of the milling plate and the pressure-receiving member in a reverse direction with respect to each other allows application of high milling force to the to-be-milled material, thereby improving the mill efficiency.

According to one aspect of the present invention, concave-convex pattern provided on surface of at least any one of the milling plate and the pressure-receiving member increases the number of parts where the to-be-milled material are rubbed hard by the milling plate or the pressure-receiving member, thereby improving the mill efficiency.

According to one aspect of the present invention, said milling plate has a wavy curved-surface structure where peaks and valleys are iteratively provided at certain spacing in a circumference direction, and as a result, the to-be-milled material can be rubbed hard by the milting plate or the pressure-receiving member, thereby improving the mill efficiency. Moreover, smooth curved surface of the milling plate makes it difficult to easily crush the to-be-milled material.

According to one aspect of the present invention, since a hopper for putting the to-be-milled materials into the drum body is provided on a central part of the drum body in a longitudinal direction, a discharge spout for discharging the to-be-milled materials from said drum body is provided on both ends of the drum body in a longitudinal direction, the milling plates are attached to be inclined with respect to a plane intersecting said central shaft at a right angle and rotate with said central shaft, and said milling plates at one side and the other side across the said hopper are oppositely inclined with respect to each other, it is possible to transfer the to-be-milled materials taken in from the hopper into the drum body to the right and left side of the drum body, respectively, mill the transferred materials, and then separately discharge the materials from the discharge spout provided on left and right ends of the drum body. Therefore, it is possible to almost double the mill efficiency, compared with the mill for transferring the to-be-milled materials in only one direction, from one end to the other end of the drum body.

According to one aspect of the present invention, the milling plate is attached to be inclined with respect to the plane intersecting the central shaft at a right angle and rotates with the central shaft, the pressure-receiving member has an inclined plane which is attached to intersect the central shaft at a right angle and is inclined with respect to a plane intersecting the central shaft at a right angle so that a plane facing the milling plate will be substantially circular truncated cone-shaped, an inclined angle of the inclined plane with respect to the plane intersecting the central shaft at a right angle is substantially equal to an inclined angle of the milling plate with respect to the plane intersecting the central shaft at a right angle. As a result, trajectory of rotary motion of the milling plate shows a shape of figure eight, and at this time, the milling plate and an inclined surface of the pressure-receiving member will be facing parallel to each other. This allows the to-be-milled material to be always rubbed between surface of the milling plate and surface of the pressure-receiving member during the rotation of the milling plate, thereby remarkably improving the mill efficiency. In addition, rotation of the milling plate generates wind like a fan, and accordingly, the to-be-milled material can be easily transferred in the drum body.

According to one aspect of the present invention, a discharge spout for discharging the to-be-milled material from the drum body is provided with as mechanism for changing discharge spout areas, which can change site of the discharge spout. Therefore, the residence time (milling processing time) of the to-be-milled material in the drum body can be easily adjusted.

According to one aspect of the present invention, placement of a sieve member on the other part of the drum body for discharging the to-be-milled, material allows to continuously carry out a step of sorting the milled to-be-milled material into several grades (sizes) based on purposes and a step of milling, thereby improving efficiency through the step.

According to one aspect of the present invention, placement of at least one conveyor device for carrying the to-be-milled material sorted by the sieve member allows to place a large container for separately storing the sorted to-be-milled material based on purpose, without interfering the mill.

DETAILED DESCRIPTION OF THE INVENTION

Figure 1:
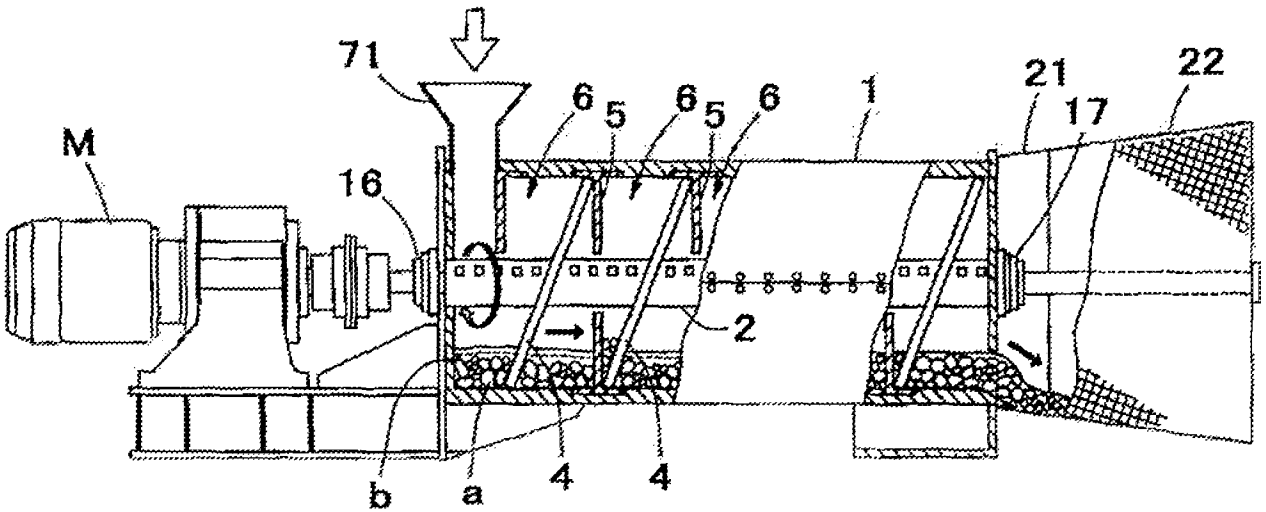
FIG. 1—It is a front and partial sectional view of a mill according to a first embodiment of the present invention.

Hereinafter, embodiments of the mill according to the present invention will be set forth with reference to drawings. FIG. 1 is a front and partial sectional view of the mill according to a first embodiment of the present invention. The mill according to the first embodiment of the present invention comprises a cylindrical drum body (1) configured so that a to-be-milled material (raw materials) can be taken in through a part of the mill (a hopper (71)) and be discharged from the other part (a discharge hopper (21)), a central shaft (2) penetrating the drum body (1) in a longitudinal direction, a plurality of milling plates (4) which are attached with predetermined spacing in a longitudinal direction of the central shaft (2) and divide interior space of the drum body (1) into a plurality of milling chambers (6), and a pressure-receiving member (5) which is attached to the drum body (1) and faces the milling plate (4). On downstream side of the discharge hopper (21) is attached a sieve member (22) which rotates with the central shaft (2). Both ends of the central shaft (2) are supported by a pair of bearing members (16) and (17). To one end (upstream) of the central shaft (2) is coupled a motor (M) used as a drive source for rotating the central shaft (2) and to the other end (downstream) is attached the sieve member (22). The sieve member (22) has cylindrical shape with a taper whose diameter becomes gradually larger as it moves away from the drum body (1).

The drum body (1) is in a substantially cylindrical shape and consists of a combination of upper and lower semicylindrical members. A plurality of milling plates (4) are provided with predetermined spacing in a shaft direction of the central shaft and divide interior space of the drum both (1) into a plurality of milling chambers (6). Each milling plate (4) is inclined with respect to the pine intersecting the central shaft (2) at a right angle, and is substantially parallel to each other. Each milling chamber (6) has no milling media (a ball, a rod, etc) which mills the to-be-milled material by contacting the to-be-milled material therewith while moving by rolling in the drum body. A plurality of pressure-receiving members (5) is placed in each milling chamber (6) and intersects the central shaft (2) at right angles, respectively. For the mill of this embodiment, a to-be-milled material (a), together with water (b), are supplied from the hopper (71) and passed through each milling chamber (6) sequentially. Then, they are discharged from the discharge hopper (21) located at the most downstream side of the drum body (1) and sent to the sieve member (22).

However, instead of such a wet construction, a dry construction sending the to-be-milled material (a) due to the action of rotation etc. of the milling plate with/without a blower may be employed. In addition, any of the wet construction or the dry construction may be employed in the below-described second to fourth embodiments.

Figure 3:
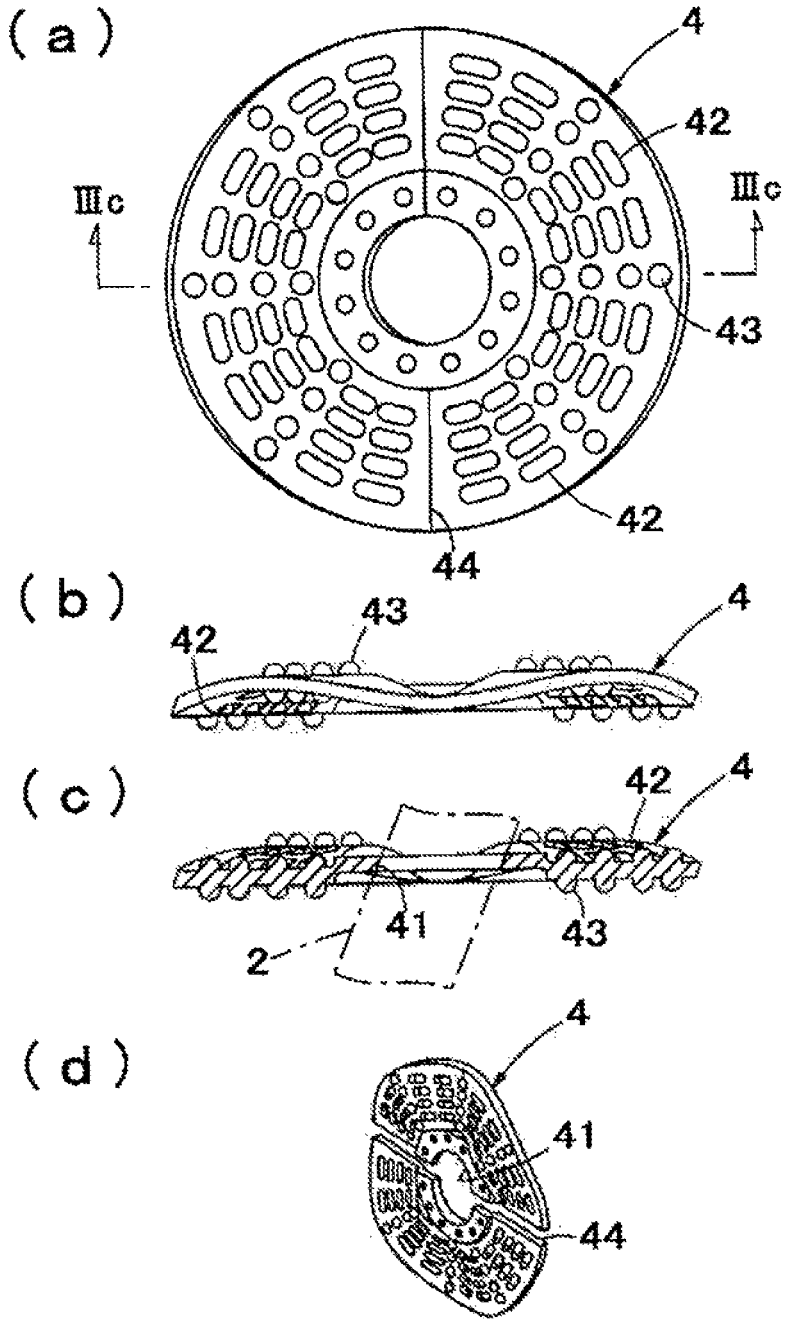
FIG. 3—It shows a milling plate according to the first embodiment, and (a) is a plan view, (b) is a side view, (c) is a sectional view taken along lines IIIc-IIIc, and (d) is a perspective view.

FIG. 3 shows a milling plate according to the embodiment and (a) is a plan view, (b) is a side view, and (c) is a sectional view taken along lines IIIc-IIIc. The milling plate (4) has a substantially circular structure formed by combining two semicircle-like curved plates, and the central shaft (2) is inserted into as central hole (41). The milling plate (4) is attached to be inclined clockwise from the plane intersecting the central shaft (2) at a right angle. In addition, even if the inclined direction of the milling plate (4) is contrary to this embodiment, no disadvantage will arise for the milling processing, for the to-be-milled material (a) are moved due to water flow (in case of the we construction) or air flow (in case of the dry construction). The milling plate (4) has a plurality of partially-arc through holes (42) arranged in a concentric pattern. Arc width of the through hole (42) is set sufficiently small so that only the to-be-milled material which was milled to less than a predetermined particle size can pass therethrough. Size (arc width) of the through hole (42) may be gradually decreased from as milling plate (4) on upstream side of the drum body (1) towards a milling plate (4) on the downstream side. In case of obtaining final to-be-milled material with 0-25 mm, for instance, the size of the through hole (42) can sequentially be decreased to 50 mm, 40 mm, 35 mm, 30 mm, and 25 mm, from upstream towards downstream. This can be applied to the milling plates of the below-described second to fourth embodiments.

Furthermore, as shown in FIGS. 3(*b*) and (*c*), a hemispherical convex part (43) is provided on surface of the milling plate (4) and thus a large concave-convex pattern is formed thereon. This large concave-convex pattern could have some good effect. For example, when the to-be-milled material (a) diagonally hit the stilling plate (4), they are rubbed by a convex part (43) by slightly sliding on the surface of the milling plate (4), which leads to improvement of the mill efficiency of the to-be-milled material (a). It is also possible to compose only the convex part (43) of the milling plate (4) of an especially hard material (for example, cemented carbide), reduce wear of the milling plate (4), and extend the period of endurance. Instead of the convex part (43) a large concave-convex pattern having relatively larger concave parts may be formed. In this case, the same effect as in the concave-convex having the convex part (43) can be achieved.

Here, the FIG. 1 shows a tabular milling plate (4) for easy recognition but the milling plate (4) in this embodiment has a wavy curved-surface structure where peaks and valleys are iteratively provided at certain spacing in a circumference direction, as shown in FIG. 3. The wavy curved-surface structure means that it has peaks on the surface and valleys on the back surface. However, the milling plate (4) may have planar structure. The milling plate (4) may be not a circular plate but an elliptic plate as a whole. The similar curved-surface structure may be used for the below-described pressure-receiving member (5).

Figure 2:
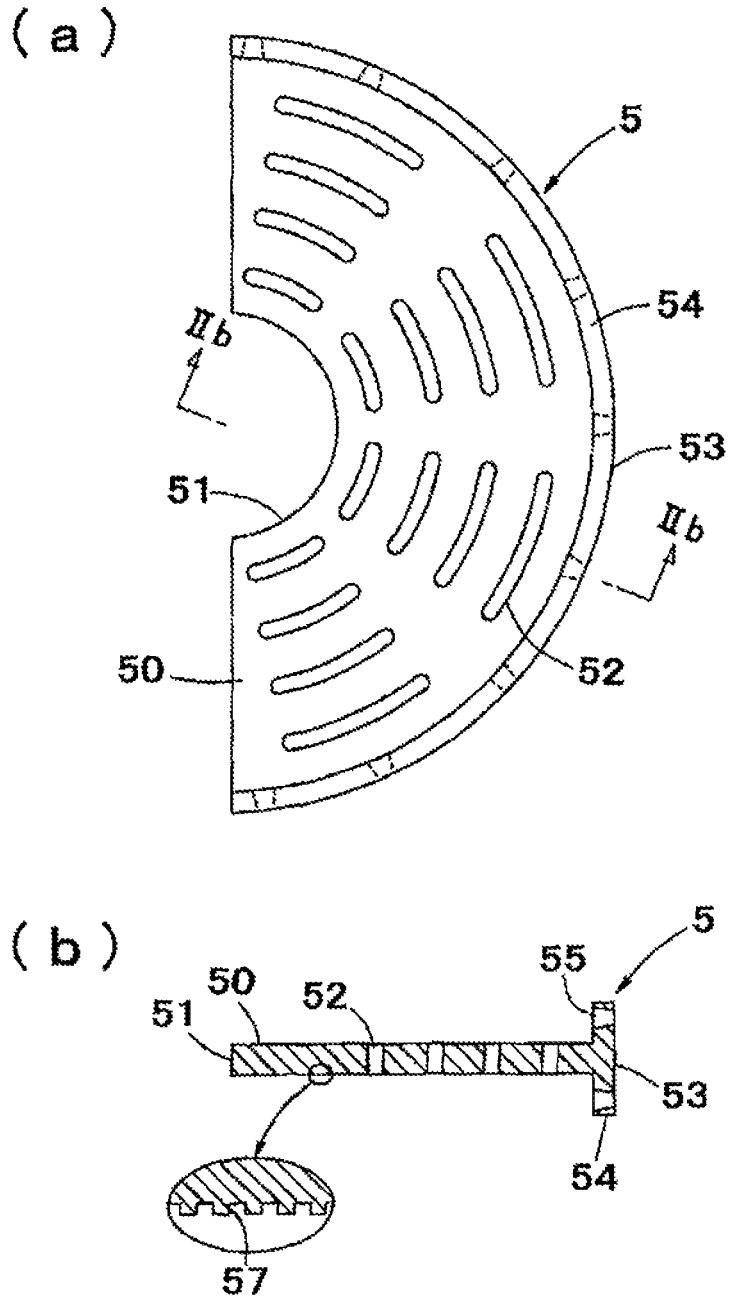
FIG. 2—It shows a pressure-receiving member according to the first embodiment, and (a) is a plan view, (b) is a sectional view taken along lines IIb-IIb.

FIG. 2 shows a pressure-receiving member according to the embodiment, and (a) is a plan view, (b) is a sectional view taken along lines IIb-IIb. The pressure-receiving member (5) is divided into two parts in response to the semicylindrical drum body (1), and has a semidisc part (50) in a substantially semidisc shape and a flange part (54) surrounding outer periphery of the semidisc part (50). For the semidisc part (50), when the two pressure-receiving members (5) are combined, a semicircular inner periphery edge (51) is formed in the central part of the combined structure and faces the central shaft (2) with a predetermined spacing therebetween. The pressure-receiving member (5) is attached to the drum body (1) with screws (not shown), with an outer periphery (53) of the semicylindrical flange part (54) being in contact with inner wall of the drum body (1). The flange part (54) has insertion holes for screws (55).

For easy recognition, a cross sectional view of the pressure-receiving member (5) in FIG. 1 is omitted, but there are many partially-arc through holes (52) arranged in a concentric pattern on the semidisc part (50) of the pressure-receiving member (5). The arc width of the through hole (52) is set sufficiently small so that only the to-be-milled material (a) which was milled to less than a predetermined particle size in the milling chamber (6) can pass therethrough. Arc width of the through hole (52) may be gradually decreased from the pressure-receiving member (5) on upstream side of the drum body (1) towards the pressure-receiving member (5) on downstream side. In addition, the semidisc part (50) and the flange part (54) of the pressure-receiving member (5) have fine concave-convex patterns (57) formed by casting, press molding, or the like, as shown in the partial enlarged view of the FIG. 2 (*b*). The pressure-receiving member (5) in this embodiment has flat-plate structure, but, the pressure-receiving member (5) may have any curved-surface structures, as set forth below. For example, the pressure-receiving member (5) can be any protruded structure shaped when seen from the front view, such as, piled-cone structure shaped when seen from the front view and abacus's bead shaped when seen from front view. Moreover, the pressure-receiving member (5) may not be a circular plate but an elliptic plate as a whole when seen from side view. In addition, "when seen from front view or side view" means the mill when seen from front view or side view.

In the present invention, at least any one of the milling plate (4) and the pressure-receiving member (5) may rotate. However, this embodiment is configured so that the drum body (1) is fixed and the central shaft (2) rotates. Therefore, in this embodiment, the central shaft (2) rotates and the milling plate (4) attached to the central shaft (2) rotates, while the pressure-receiving member (5) attached to the drum body (1) remains stationary.

Figure 6:
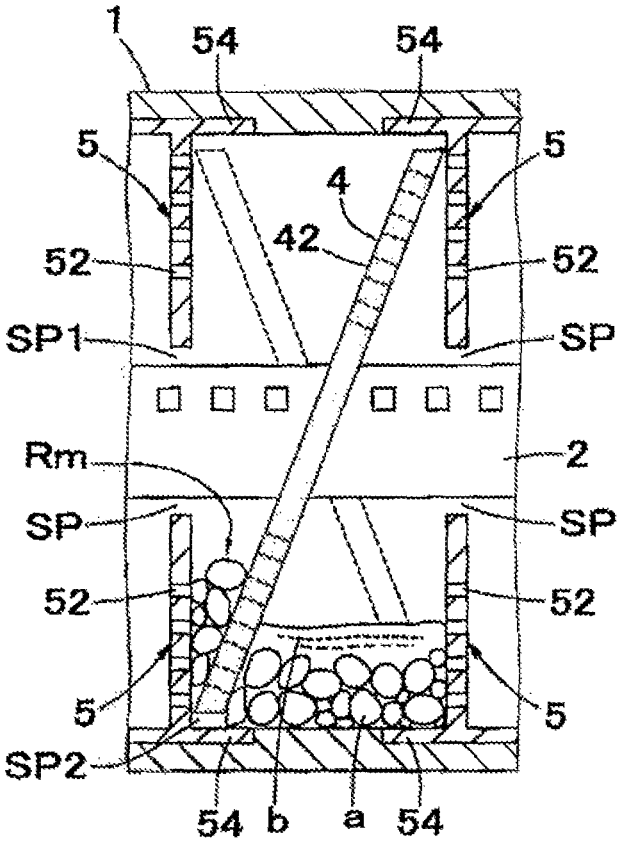
FIG. 6—It is sectional view for explaining milling action with the pressure-receiving member and the milling plate.

FIG. 6 is a sectional view for explaining milling action with the pressure-receiving member and the milling plate. As shown in the FIG. 6, when the milling plate (4) rotates 180 deuces from a solid position, it reaches a dashed position. Then, the milling plate (4) iteratively rotates so that it will return to the solid position again. During the rotation, the to-be-milled material (a) are strongly pressed between the milling plate (4) and the pressure-receiving member (5) and subjected to friction force generated by the rotation of the milling plate (4) in a narrower room (Rm) created by approach of the milling plate (4) and the pressure-receiving member (5). As a result, the to-be-milled material (a) are rubbed by the pressure-receiving member (5) and the milling plate (4), or rubbed by each other, leading to efficient removal of foreign matters such as cement adhered to the surface of the to-be-milled material (a). The to-be-milled material (a) passes through the through holes (42) (52) of the milling plate (4) and the pressure-receiving member (5), the space (Sp1) between the pressure-receiving member (5) and the central shaft (2), and the space (Sp2) between the milling plate (4) and the drum body (1), and then is sent to the downstream side with water (b). At that time, edges of many through holes (42) (52) provided on the milling plate (4) and the pressure-receiving member (5) can scrape the foreign matters, too, thereby eliminating the foreign matters more effectively.

The structure of the mill according to the present invention is not limited, to the structure shown in FIG. 1. For example, only the pressure-receiving member (5) may be rotated and the milling plate (4) may be fixed. In that case, only the drum body (1) rotates and even if the to-be-milled material (a) strongly hit the drum body (1), the milling plate (4), and the pressure-receiving member (5) due to the centrifugal three caused by the rotation of the drum body (1), loud noise such as the one caused by the clash of the drum body (1) and the milling media never occurs. Additionally, the rotation of the drum body (1) can provide large centrifugal force for the to-be-milled material (a), and thus the clash of the to-be-milled material (a) with the flange part (54) of the pressure-receiving member (5) improves the mill efficiency. Moreover, the milling plate (4) and the pressure-receiving member (5) may rotate in a reverse direction with respect to each other. In that case, the frictional force acting on the to-be-milled material (a) held between the milling plate (4) and the pressure-receiving member (5) can be increased, thereby improving the mill efficiency.

Figure 5:
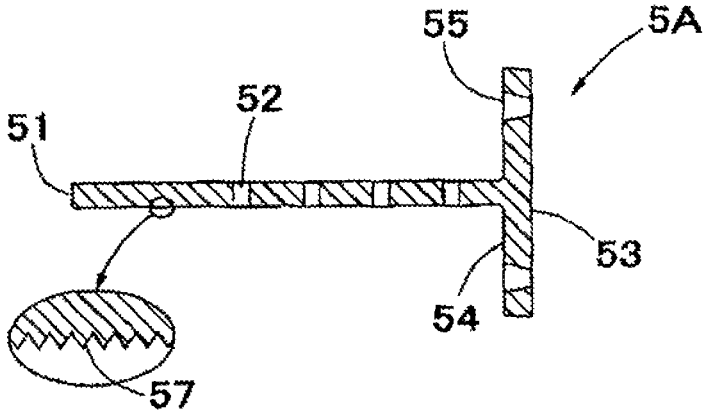
FIG. 5—It is a sectional view showing a first modified example of the pressure-receiving member.

FIG. 5 is a sectional view showing the first modified example of the pressure-receiving member (5). In the pressure-receiving member (5) according to the first modified example, a flange part (54) with wider width than that shown in FIG. 2(*b*) is provided, for example, it extends to a midway point of each ruffling chamber (6). Thus, making the width of the flange part (54) wider alloys an area of an inner side plane of the flange part (54) which a to-be-milled material (a) hits to become larger, leading to an increase of mill efficiency.

Also, as shown in the partially enlarged view of FIG. 5, a fine concave-convex pattern (57) formed by sandblast etc. is formed on a surface of the semidisc part (50) or the flange part (54) of the pressure-receiving member (5). Due to the fine concave-convex pattern (57) shown in FIG. 2 (*b*) or FIG. 5, when a to-be-milled material (a) diagonally hits the surface of the pressure-receiving member (5), it becomes likely to be rubbed hard without sliding on the surface of the pressure-receiving member (5). Therefore, providing the fine concave-convex pattern (57) on the pressure-receiving, member (5) allows mill efficiency of a to-be-milled material (a) to further increase. Providing the fine concave-convex pattern also on the ruffling plate (4) may increase mill efficiency of a to-be-milled material (a), although this is not shown in FIG. 3. However, the fine concave-convex pattern is not necessarily provided on the milling plate (4) or the pressure-receiving member (5). Moreover, a large concave-convex pattern having a convex part and a concave part like a miffing plate (4) may be also farmed on the pressure-receiving member (5), although this is not shown in FIG. 2(*b*) or FIG. 5 (See a modified example which will be mentioned later). In even such a case, the above-mentioned acting effect can be achieved.

Constituent materials of the milling plate (4) and the pressure-receiving member (5) include, but not limited to, general-purpose steel materials, high hardness iron and steel materials such as alloy steels, cemented carbides, ceramics, and metal-ceramics composite materials, etc. In order to increase mill efficiency or extend a durable period, the materials with higher hardness is preferable. Only a part, for example, a surface of the milling plate (4) or the pressure-receiving member (5) comprised, of general-purpose steel materials may be comprised of the high hardness materials. The same can be also applied to second to fourth embodiments which will be mentioned later.

Figure 4:
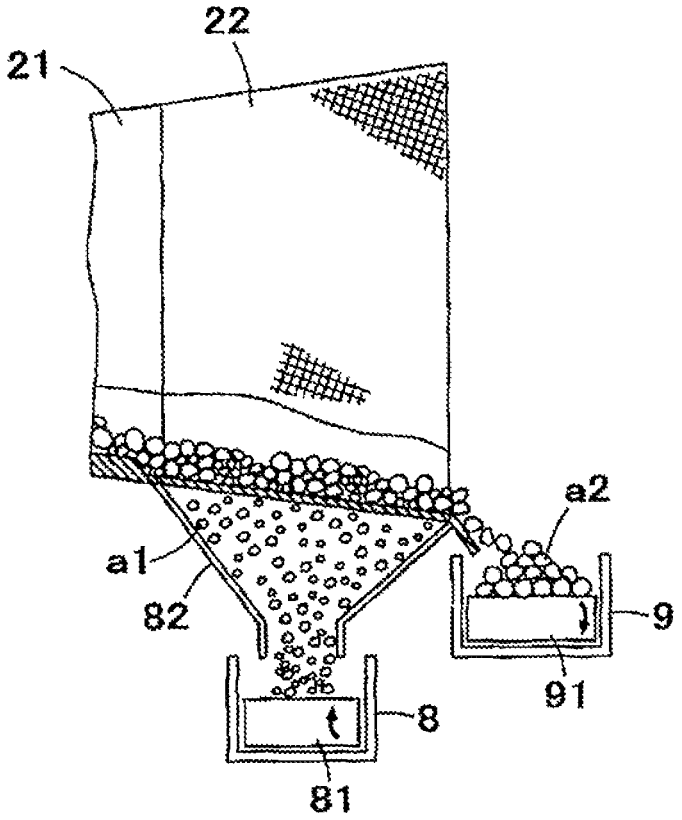
FIG. 4—It is a from and partial sectional view of a sieve member and a conveyor device according to the first embodiment.

FIG. 4 is a front and partial sectional view of a sieve member and conveyor device according to this embodiment. A guiding member (82) to receive a to-be-milled material (a1) having a relatively small diameter which passed through a mesh of the sieve member (22) and a first delivery device (8) arranged below the guiding member (82) are arranged below the sieve member (22). To the first delivery device (8), is attached a first conveyor device (81) which delivers the to-be-milled material (a1) backward from its position in FIG. 4. Near a downstream side of the sieve member (22), is arranged a second delivery device (9) which receives a to-be-milled material (a2) having a relatively large diameter which is delivered, without passing through a mesh of the sieve member (22). To the second delivery device (9), is attached a second conveyor device (91) which delivers the to-be-milled material (a1) forward from its position in FIG. 4.

As in this embodiment, the sieve material (22) is provided on a downstream end part of the mill and sorts milled to-be-milled materials into sizes depending on intended uses, and thus the sorting process can be continuously carried out with a milling process, allow overall efficiency to improve. The size of the mesh of the sieve member (22) can be optionally chosen depending on the type of an aggregate to be finally obtained. For example, in sorting the to-be-milled materials into gravel and sand, a mesh with a size of, for example, about 5 mm can be used. A punching metal (steel plate) is generally used for a material of the sieve member (22), but not specifically limited to this.

Figure 7:
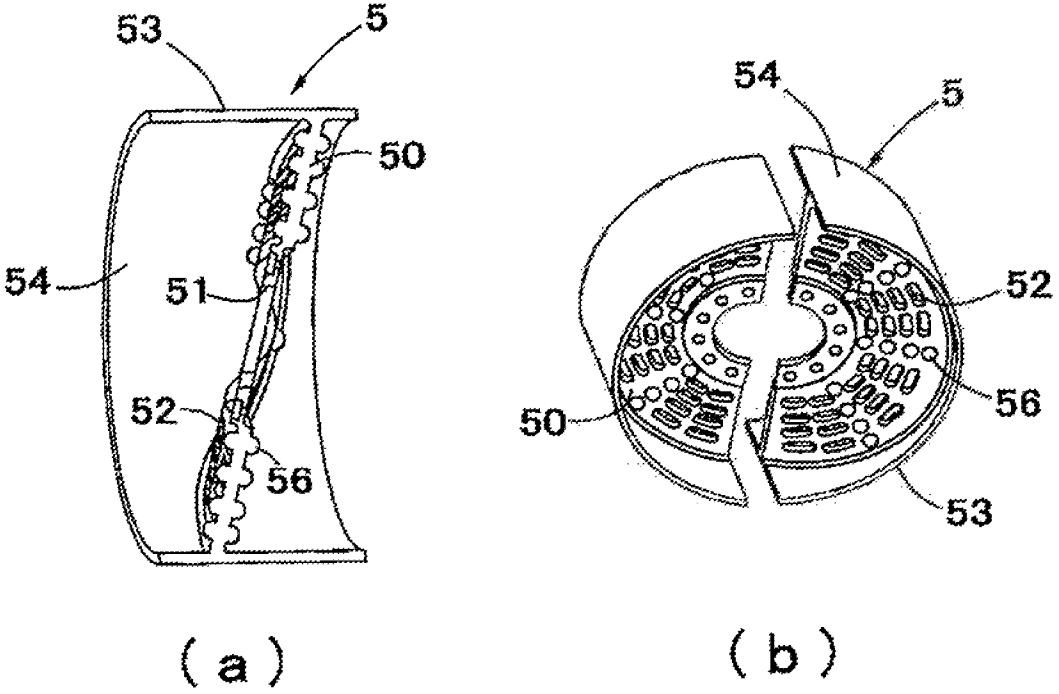
FIG. 7—It shows a second modified example of the pressure-receiving member, and (a) is a perspective view of one pressure-receiving member and (b) is a perspective view of combined two pressure-receiving members.

Also, as in this embodiment, an arrangement of the conveyor device (81) and (91) which carry the to-be-milled materials (a1) and (a2), respectively, allows a large sized container which separates and receives the sorted to-be-milled materials (a1) and (a2) for intended uses to be arranged without interfering with the mill. Besides, the number of a sieve member may be two or more pieces, and depending on that number, three or more conveyor devices (delivery devices) may be arranged. Next, modified examples of a pressure-receiving member (5) will be explained. FIG. 7 illustrates a second modified example of the pressure-receiving member, and (a) is a perspective view of one pressure-receiving member and (b) is a perspective view of combined two pressure-receiving members. The pressure-receiving member (5) according to the second modified example has a semidisc part (50) similar in shape to a milling plate (4) shown in FIG. 3. That is, the semidisc part (50) consists of a curved surface inclining with respect to a plane intersecting at a right angle to a central shaft (2), and a large number of arranged convex parts (56) arranged in a concentric pattern (concave-convex pattern) and a large number of partially arc-shaped through holes (52) arranged in a concentric pattern are provided on the semidisc part (50), with its inner periphery edge (51) facing the central shah (2) with spacing therebetween. The arc width of the through hole (52) is set sufficiently small so that only the to-be-milled material (a) which was milled to less than a predetermined particle site can pass therethrough. A flange part (54) with wider width is provided as in the case in the first modified example, and the pressure-receiving member (5) is attached to a drum body (1) with a peripheral part (53) of the flange part (54) contacting with the drum body (1).

Thus, when a pressure-receiving member (5) is used with its semidisc part (50) inclining with respect to a plane intersecting at a right angle to a central shaft (2), the milling plate (4) preferably intersects at a right angle to a central shaft (2). The milling plate (4) may be a planar structure or curved-surface structure, for example the milling plate (4) in substantially same shape as the semidisc part (50) of the pressure-receiving member (5) in FIG. 2 can be used.

Figure 8:
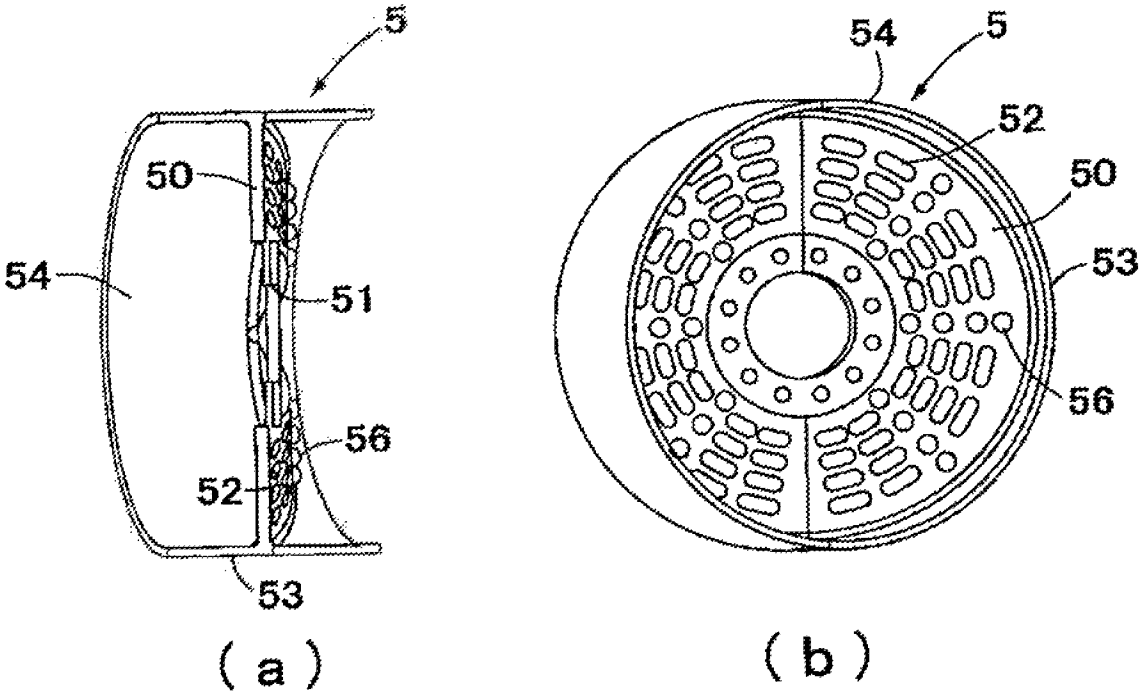
FIG. 8—It shows a third modified example of the pressure-receiving member, and (a) is a perspective view of one pressure-receiving member and (b) is a perspective view of combined two pressure-receiving members.

FIG. 8 illustrates a third modified example of the pressure-receiving member, and (a) is a perspective view of one pressure-receiving member and (b) is a perspective view of combined two pressure-receiving members. The pressure-receiving member (52) according to the third modified example has a semidisc part (50) intersecting at a right angle to a central shaft (2). A large number of arranged convex parts (56) arranged in a concentric pattern (concave-convex pattern) and a large number of partially arc-shaped through holes (52) arranged in a concentric pattern are provided on the semidisc part (50), with its inner periphery edge (51) facing the central shaft (2) with spacing therebetween. The arc width of the through hole (52) is set sufficiently small so that only the to-be-milled material (a) which was milled to less than a predetermined particle size can pass therethrough. A flange part (54) with wider width is provided as in the case in the first modified example, and the pressure-receiving member (5) is attached to a drum body (1) with a peripheral part (53) of the flange part (54) contacting with the drum body (1).

Thus, when a pressure-receiving member (5) is used with its semidisc part (50) inclining from a central shaft (2), the milling plate (4) preferably inclines with respect to a central shaft (2). The milling plate (4) may be a planar structure or curved-surface structure.

Figure 9:
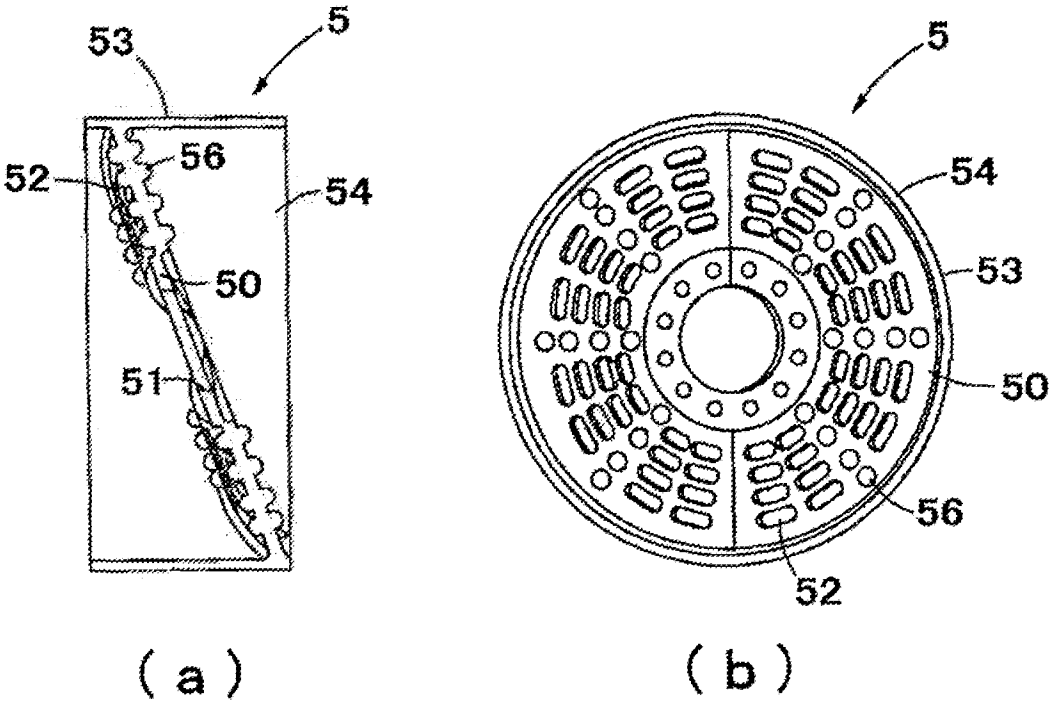
FIG. 9—It shows a fourth modified example of the pressure-receiving member, and (a) is a perspective view of one pressure-receiving member and (b) is a perspective view of combined two pressure-receiving members.

FIG. 9 illustrates a fourth modified example of the pressure-receiving member, and (a) is a perspective view of one pressure-receiving member and (b) is a perspective view of combined two pressure-receiving members. The pressure-receiving member (5) according to the fourth modified example has a semidisc part (50) and a flange part (54) which are in substantially same shape as the pressure-receiving member (5) according to the second modified example in FIG. 7. A difference between the pressure-receiving member (5) according to the fourth modified example and the pressure-receiving member (5) according to the second modified example is that each semidisc part (50) is inclined in an opposite direction with respect to a plane intersecting at a right angle to a central shaft (2). That is, the pressure-receiving member (5) according to the second modified example is inclined in a clockwise direction with respect to a plane intersecting at a right angle to a central shaft (2), while the pressure-receiving member (5) according to the fourth modified example is inclined in a counterclockwise direct on with respect to a plane intersecting at a right angle to a central shaft (2). Regardless whether the pressure-receiving member (5) is inclined in to the direction in the second modified example or the direction in the fourth modified example, a to-be-milled material (a) is transferred smoothly and no disadvantage for a milling process will arise. Even in the case of using the pressure-receiving member (5) according to the fourth modified example, the milling plate (4) preferably intersects at a right angle to a central shaft (2). The milling plate (4) may be a planar structure or curved-surface structure, for example the milling plate (4) in substantially same shape as the semidisc part (50) of the pressure-receiving member (5) in FIG. 2 can be used.

As will be easily understood from above-described each modified example, structures or materials of the milling plate (4) and the semidisc part (50) of the pressure-receiving member (5) may be the same. In addition, one of the milling plate (4) and the semidisc part (50) of the pressure-receiving member (5) may incline from a plane intersecting at a right angle, or both may be inclined. Although both may not be necessarily inclined, there is preferably at least a narrow room (Rm) where the to-be-milled material (a) is held between the milling plate (4) and the pressure-receiving member (5).

All the above-mentioned milling plates and the pressure-receiving members can be applied even in second to fourth embodiments which will be described later.

Figure 10:
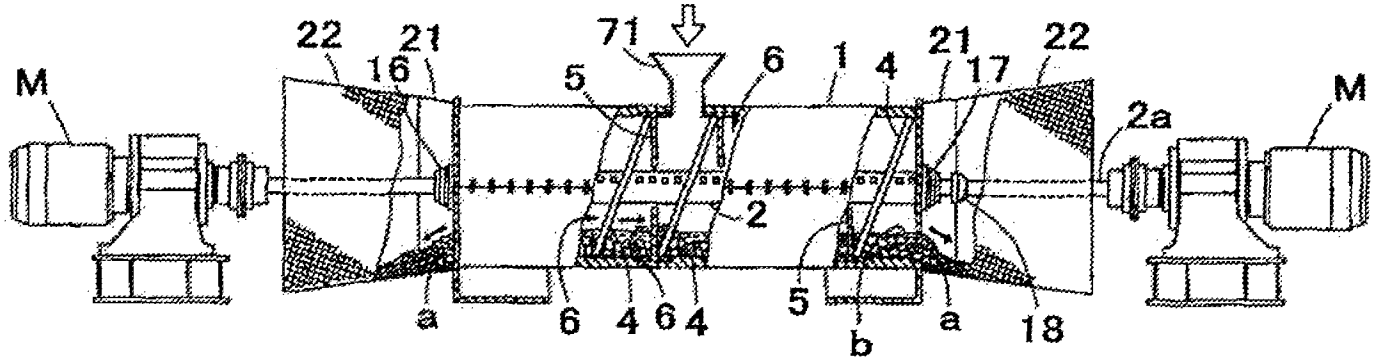
FIG. 10—It is a front and partial sectional view of the mill according to the modified example of the overall structure.

Next, a modified example of a whole structure of a mill will be explained. FIG. 10 is a front and partial sectional view of the mill according to the modified example of the whole structure. As shown in the figure, the mill according to this modified example has a hopper (71) for putting in the to-be-milled material (a) (raw material) on a central part of the drum body (1), and a hopper for discharge (21), a sieve member (22), and a motor (M) on right and left sides of the churn body (1). Also, it has a sieve rotational shaft (2*a*) separated from the central shaft (2) to rotate one of the sieve members (22) (right side in the figure), and the central shaft (2) and the sieve rotational shaft (2*a*) are rotatably supported by a bearing member (18) with respect to each other. In addition, it may be possible to rotate the sieve members (22) together with the central shall (2) by connecting the motors (M) to both ends of the central shaft (2), respectively, and synchronizing and rotating the motors (M) on the both sides. In this case, the central shaft (2) and the sieve rotational shaft (2*a*) would be integrated. According to the structure of this modified example, it is possible to substantially improve processing capacity (by about twice) by putting in the raw materials from a center of the drum body (1) and discharging them from the sieve members on the both sides.

Figure 11:
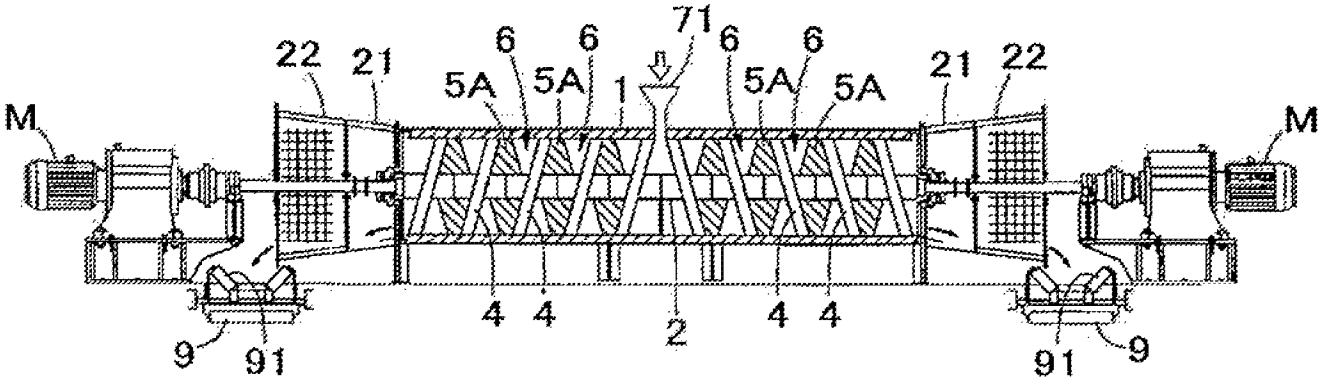
FIG. 11—It is a front and sectional view of the mill according to the second embodiment of the present invention.
Figure 12:
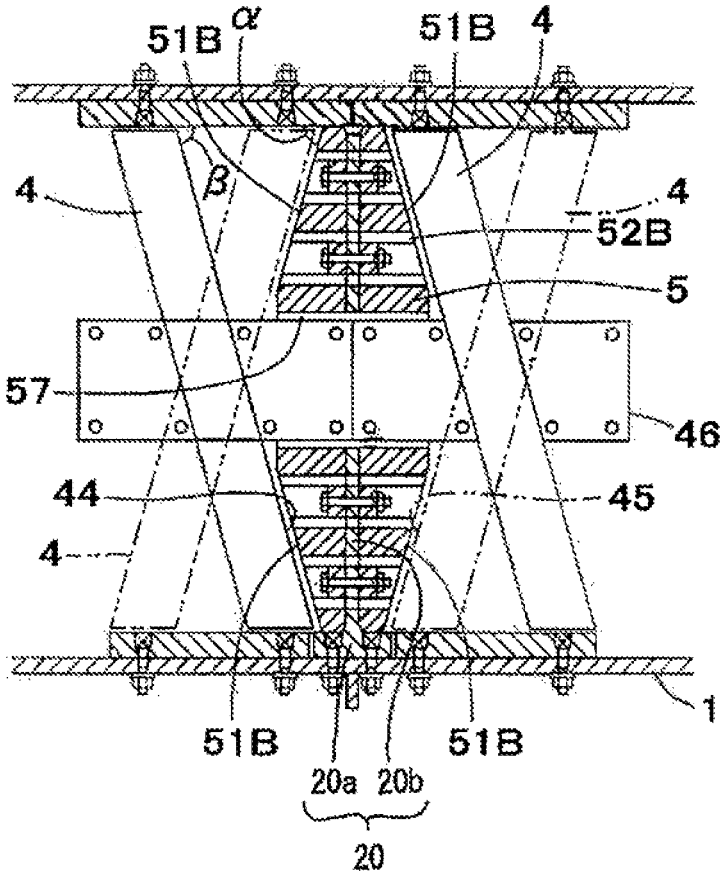
FIG. 12—It is an enlarged view showing main parts of the mill according to the second embodiment.

FIG. 11 is a sectional front view of the mill according to the second embodiment of the present invention, and FIG. 12 is an enlarged view of a main part of FIG. 11. Hereinafter, different configuration between the mill according to the second embodiment of the present invention and that of the mill according to the above-mentioned first embodiment of the present invention will be set forth. Besides, same reference numbers are allotted to the same configurations as those of the mill of the above-mentioned first embodiment.

As in the case of the mill in FIG. 10, the mill of the second embodiment has a hopper (71) for putting in the to-be-milled material (raw material) on a central part of the drum body (1), and a hopper for discharge (21), as sieve member (22), and a motor (M) on right and left sides of the drum body (1). On a downstream side of the sieve member (22), is arranged a second delivery device (9) which receives a to-be-milled material having a relatively large diameter which is delivered without passing through a mesh of the sieve member (22). To the second delivery device (9), a second conveyor device (91) is attached to deliver the to-be-milled material forward from the position in FIG. 11. Besides, a guiding member to receive a to-be-milled material having a relatively small diameter which passed through the mesh of the sieve member (22) and a first delivery device arranged below the guiding member can be arranged below the sieve member (22) as shown in FIG. 4 (not shown in figures).

A plurality of milling plates (4) is provided in shaft length directions of the central shaft at a certain interval and divide in axial length directions an inner part of the drum body (1) into a plurality of milling; chambers (6). Each milling plate (4) is inclined at an angle (β) with respect to a plane intersecting at a right angle to the central shaft (2) (See FIG. 12), and rotates together with the central shaft (2). In the example shown in FIG. 11, each milling plate (4) is provided in substantially parallel with each other, but not limited to this. In the example shown in FIG. 11, the milling plates (4) in a right half of the drum hod (1) and those in a left half of the drum body (1) are oppositely inclined with respect to each other, but they may be inclined in the same direction. Etch milling chamber (6) has no milling media (ball, etc.) as in the case with the mill of the first embodiment.

A plurality of pressure-receiving members (5) is arranged on each milling chamber (6), and intersect at a right angle to the central shaft (2), respectively. The pressure-receiving members (5) have an inclined plane (51B) which is inclined with respect to a plane intersecting at a right angle to the central shaft (2) so that a plane facing the milling plate (4) is in substantially circular truncated cone shape. The pressure-receiving members (5), in another shape, have a piled-cone structure (a shape where bottoms of two cones (truncated cones) are put together), or an abacus's head shape. A size of an inclined angle (α) to the central shall (2) of the inclined plane (51B) is almost the same as that of an inclined angle (β) to the central shaft (2) of the milling plate (4).

Since the milling plate (4) is inclined with respect to a plane intersecting at a right angle to the central shaft (2) and rotates together with the central shaft (2), a trace of rotational movement of the milling plate is in a shape of figure eight. That is, the milling plate (4) repeatedly rotates moving to an imaginary-line position and back to a solid position in turn so as to move to a position shown with the imaginary lines (two-dot chain lines) when it rotates 180 degrees from the solid position shown with solid lines in FIG. 12, and then it moves back to the solid position. Since the size of the inclined angle (α) with respect to a plane intersecting at a right angle to the central shaft (2) of the inclined plane (51B) is almost the same as that of the inclined angle (β) with respect to a plane intersecting at a right angle to the central shaft (2) of the milling plate (4), a surface of the milling plate (4) always faces the inclined plane (51B) of the pressure-receiving member (5) in parallel when the milling plate (4) rotates so that its trace will be the shape of figure eight. In particular, when the milling plate (4) is located on the solid position of FIG. 12, a surface (44) of the milling plate (4) face the inclined plane (51B) in parallel, and when the milling plate (4) is located on the imaginary-line position of FIG. 12, a surface (45) of the milling plate (4) faces the inclined plane (51B) in parallel.

Figure 13:
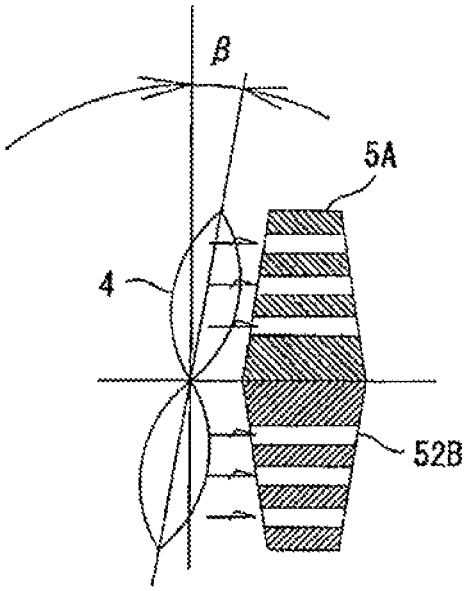
FIG. 13—It is an imaged figure showing the action of the mill according to the second embodiment.

Therefore, while the milling plate (4) is rotating, the to-be-milled material is rubbed between the surface (44) or (45) of the milling plate (4) and the surface of the pressure-receiving member (5) (inclined plane). In this case, since the milling plate (4) rotates in the shape of figure eight like a fan blade, the to-be-milled material is rubbed four times between the pressure-receiving member (5) and the milling plate (4) in one rotation of the milling plate (4), thereby greatly improving mill efficiency. Also, the milling plate (4) generates a wind like a fan while rotating. FIG. 13 is an imaged figure of the milling plate (4) which is likened to be a fan. The milling plate (4) generates a wind like a fan while rotating (See rightward arrows in FIG. 13), allowing the to-be-milled material to be easily transferred within the drum body. Especially, this allows the to-be-milled material to easily pass through the through holes provided on the pressure-receiving member (5).

Figure 14:
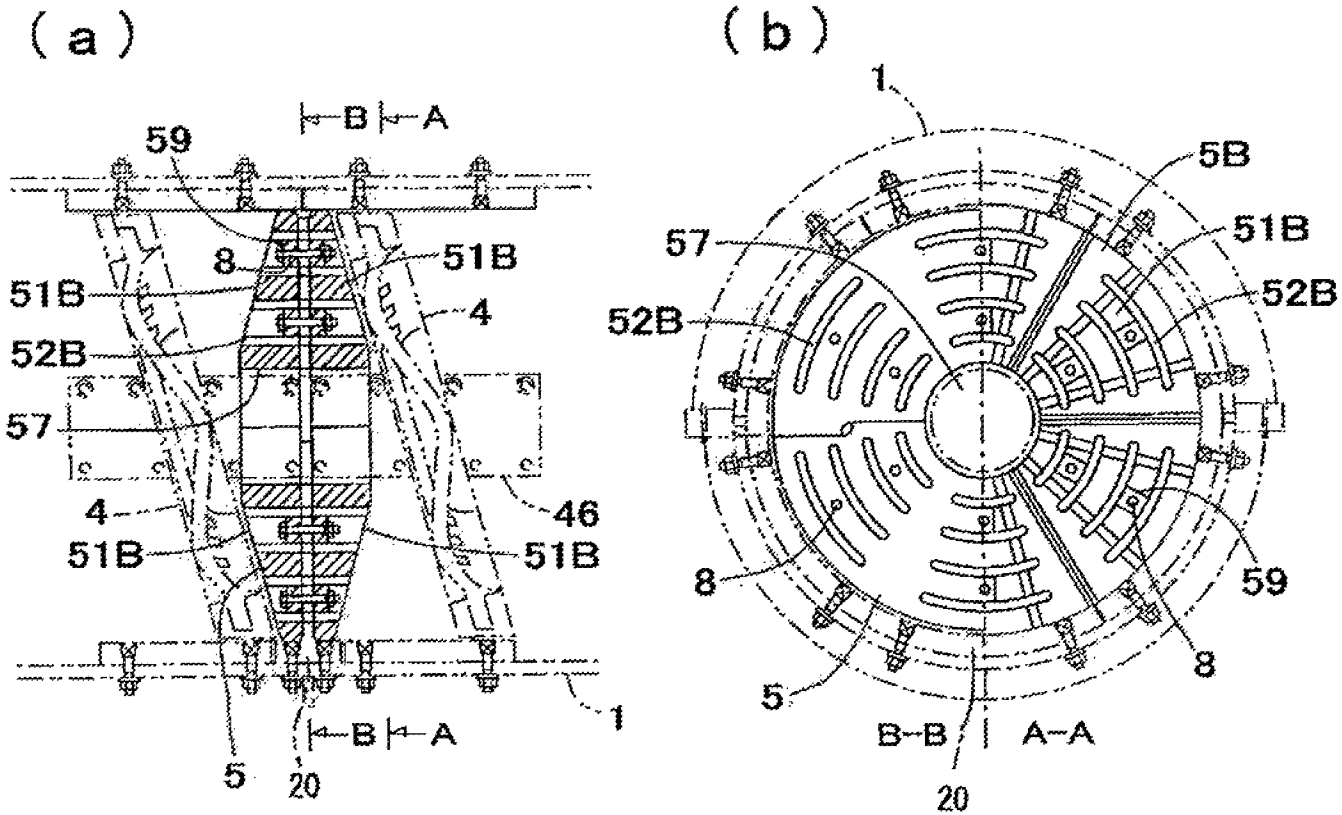
FIG. 14—It shows the pressure-receiving member according to the second embodiment, and (a) is a sectional view, (b) consists of a sectional view of a right half taken along lines A-A and a sectional view of a left half taken along lines B-B.

FIG. 14 illustrates the pressure-receiving member (5) according to the second embodiment, and (a) is a sectional view and (b) is a A-A line sectional view of (a) (right half of (b)) and a B-B line sectional view of (a) (left half of (b)). The pressure-receiving member (5) shown in FIG. 14 is in a piled-cone structure shape or an abacus's bead shape when seen from front view, as shown in FIG. 14 (*a*). Besides, a front view and side view here mean a front view and side view of the mill. The pressure-receiving member (5) is fixed to the drum body (1) by being attached to a mounting member (20) fixed to an inner surface of the drum body (1). The mounting member (20) consists of a fixed part (20*a*) fixed by bolts to a bottom surface of an inner wall of the drum body (1) and a plate-like extending part (20*b*) extending upwards from this fixed part (20*a*) and in a direction to intersect at a right angle to the central shaft (2). An upper end of the extending part (20*b*) readies a vicinity of a top surface of the inner wall of the drum body (1).

The pressure-receiving member (5) is in a circle shape, consisting of a combination of two members in substantially semicircular shapes when seen from the central shall direction (2) (members in the semicircular shape of an upper half and a lower half). A central hole (57) which the central shaft (2) is inserted into is formed on a position corresponding to this circular central part. A large number of partially arc-shaped through holes (52B) arranged in a concentric pattern are formed on the pressure-receiving, member (5). The arc width of the through hole (52B) is set sufficiently small so that only the to-be-milled material (a) which was milled, to less than a predetermined, particle size in the milling chamber (6) can pass therethrough. The arc width of the through hole (52B) may be gradually decreased from the pressure-receiving member (5) on upstream side of the drum body (1) towards the pressure-receiving member (5) on downstream side. A through hole and a central hole are also provided on the extending part (20*b*), and shapes and arrangements of this through hole and central hole correspond with the shapes and arrangements of the through hole (52B) and the central hole (57), respectively.

A bolt insertion hole (58) is provided on the pressure-receiving member (5). It is possible to fix the pressure-receiving member (5) to the mounting member (20) by fitting the mourning member (20) into a slot which is provided inside the pressure-receiving member (5) and then inserting a bolt in the bolt insertion hole (58) and fastening it with a nut. In an example of the figures, deep holes are provided on a plurality of places of the pressure-receiving member (5), and a spacer (59) having the bolt insertion hole and a shape matching the deep hole is fit into each deep hole. It is possible to fix the pressure-receiving member (5) to the mounting member (20) by pinching the mounting member (20) with a pair of spacers (59) and then inserting a bolt and fastening it with a nut. Thereby, bolts and nuts are prevented from abrading due to the to-be-milled material without protruding from a surface of the pressure-receiving member (5).

The pressure-receiving member (5) is in a piled-cone structure shape when seen from front view or an abacus's bead shape when seen from front view, as mentioned above, and its thickness increases horn its periphery edge toward the central hole (57). Therefore, the pressure-receiving member (5) has the inclined plane (51B) which is inclined with respect to a plane intersecting at a right angle to the central shaft (2) so that a plane facing the milling plate (4) is in substantially circular truncated cone shape.

The pressure-receiving member (5) of the second embodiment can be also used in the above-mentioned mill of the first embodiment.

Figure 15:
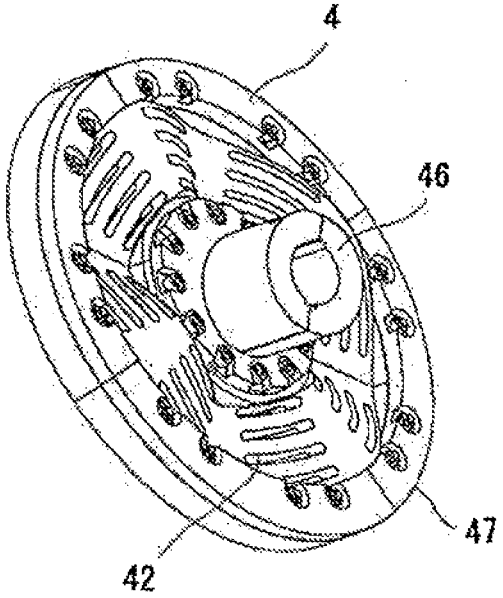
FIG. 15—It shows the milling plate according to the second embodiment, and (a) is a perspective view and (b) is a sectional view.
Figure 15:
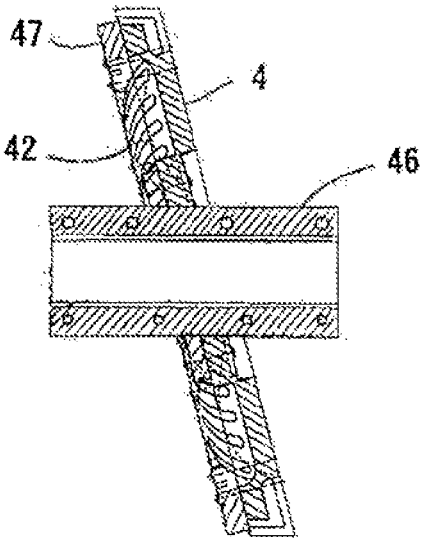

FIG. 15 illustrates the milling plate according to the second embodiment, and (a) is a perspective view and (b) is a sectional view. Besides, this milling plate can be also used in the mill of the above-mentioned first embodiment. This milling plate (4) has as structure similar to that in FIG. 3. The milling plate (4) has a substantially circular structure where two semicircle curved plates were put together, and a cylindrical body (46) having a hole which the central shaft (2) is inserted into is fixed to a center of the milling plate (4). The cylindrical body (46) is fixed inclining with respect to the milling plate (4). Thus, when the cylindrical body (46) is attached to the central shaft (2), the milling plate (4) is attached inclining from a plane intersecting at a right angle to the central shaft (2). Besides, such cylindrical body (46) is not shown in FIG. 3, but it can be also attached to the milling plate in FIG. 3. A plurality of partially arc-shaped through holes (42) arranged in a concentric pattern are provided on the milling plate (4). The arc width of the through hole (42) is set sufficiently small so that only the to-be-milled material (a) which was milled to less than a predetermined particle site can pass therethrough. The arc width of the through hole (42) may be gradually decreased from the milling plate (4) on upstream side of the drum body (1) towards the milling plate (4) on downstream side.

The milling plate (4) in this embodiment has a wavy curved-surface structure so that peaks and valleys are repeated at a certain interval in a peripheral direction. In addition, the wavy curved-surface structure means that a peak part on the surface side is a valley part on the reverse side. In an example of the figures, the wavy structure has four peaks and valleys, respectively, in other words, four S-shaped planes are consecutively formed along with a peripheral direction. Thereby, when the milling plate (4) rotates once, a to-be-milled material is rubbed four times between the milling plate (4) and a surface of the pressure-receiving member (5). However, the milling plate (4) may have a planar structure. Moreover, the milling plate (4) may not be a circular plate but an elliptic plate as a whole. A circular member (47) is attached to an outer edge part of the milling plate (4) so as to be along the outer edge part.

Figure 16:
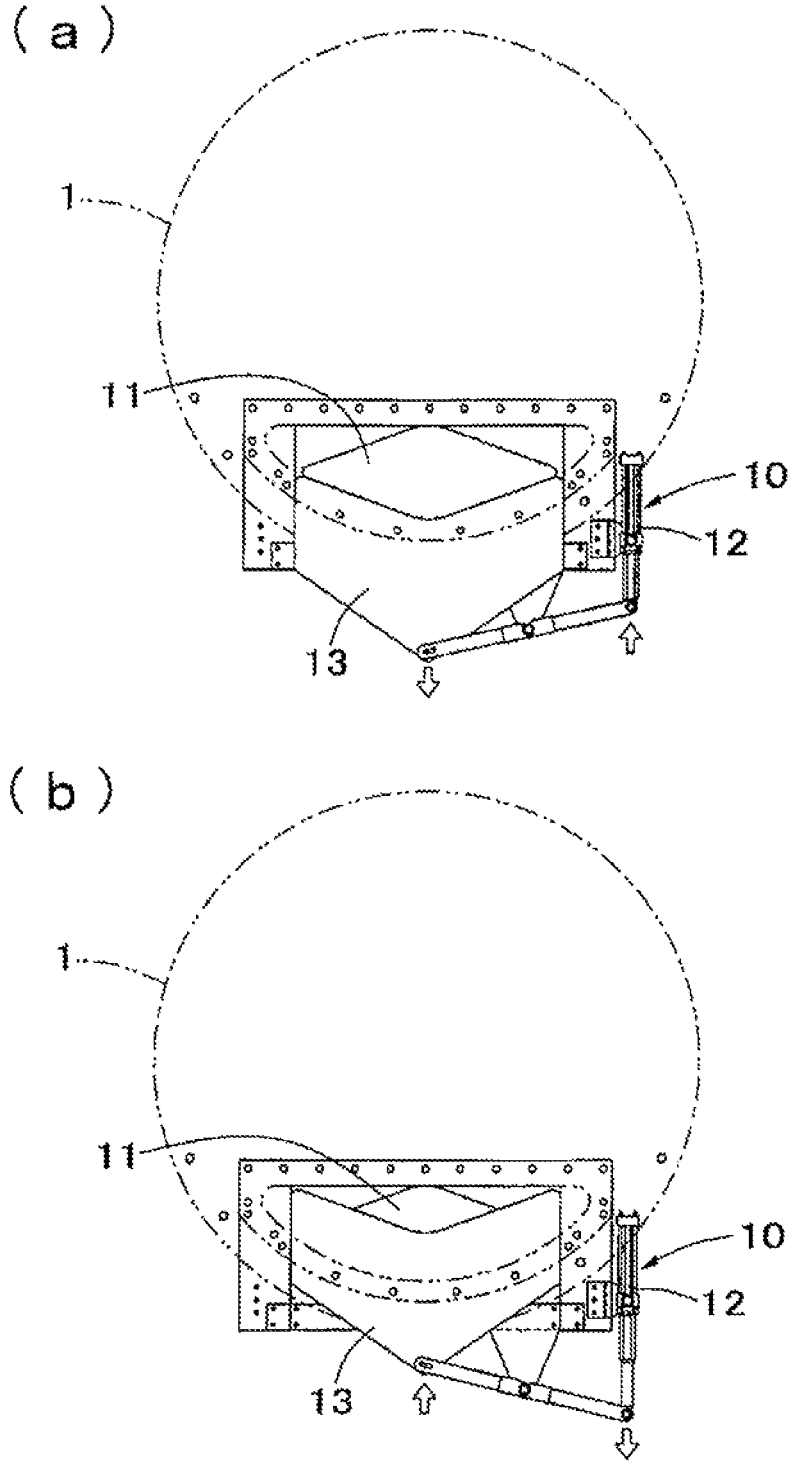
FIG. 16—It shows the configuration of a mechanism for changing discharge spout areas, and (a) shows the discharge spout with larger area and (b) shows the discharge spout with smaller area.

FIG. 16 illustrates a configuration of a mechanism for changing discharge spout area, and (a) illustrates a discharge spout with larger area and (b) illustrates a discharge spout with smaller area. The mechanism for changing discharge spout area (10) changes a size of the discharge spout (11) which discharges a to-be-milled material from the drum body (1). The discharge spout (11) is provided on a position close to a lower part of both ends of the drum body (1), and a to-be-milled material discharged from the discharge spout (11) is transferred to the sieve member (22). The mechanism for changing discharge spout area (10) comprises an oil hydraulic cylinder (12), and a cover plate (13) which reciprocally moves in accordance with expansion and contraction of a rod of this oil hydraulic cylinder (12). If the rod of the oil hydraulic cylinder (12) contracts, the cover plate (13) moves downward, and a discharge spout (11) area (area not covered with a cover body (13)) becomes larger, as shown in FIG. 16 (*a*). On the other hand, if the rod of the oil hydraulic cylinder (12) expands, the cover plate (13) moves upwards, and the discharge spout (11) area (area not covered with the cover body (13)) becomes smaller, as shown in FIG. 16 (*b*). Thus, it is possible to adjust residence time (milling processing time) of a to-be-milled material within the drum body and to can out an appropriate milling process according to a type of the to-be-milled material by adjusting the discharge spout (11) area.

In the present invention, the pressure-receiving member (5) in the mill of the first embodiment and the pressure-receiving member (5) in the mill of the second embodiment can also be removed. If the pressure-receiving member is removed, mill efficiency can decrease compared with the case where the pressure-receiving member is used but to-be-milled materials are milled by being rubbed by an inner surface of the drum body or a surface of the milling plate, or rubbed with each other. In this case, in order to improve mill efficiency, it is preferable to narrow an interval (pitch) between the placed milling plates compared with the case where the pressure-receiving member is used.

Figure 17:
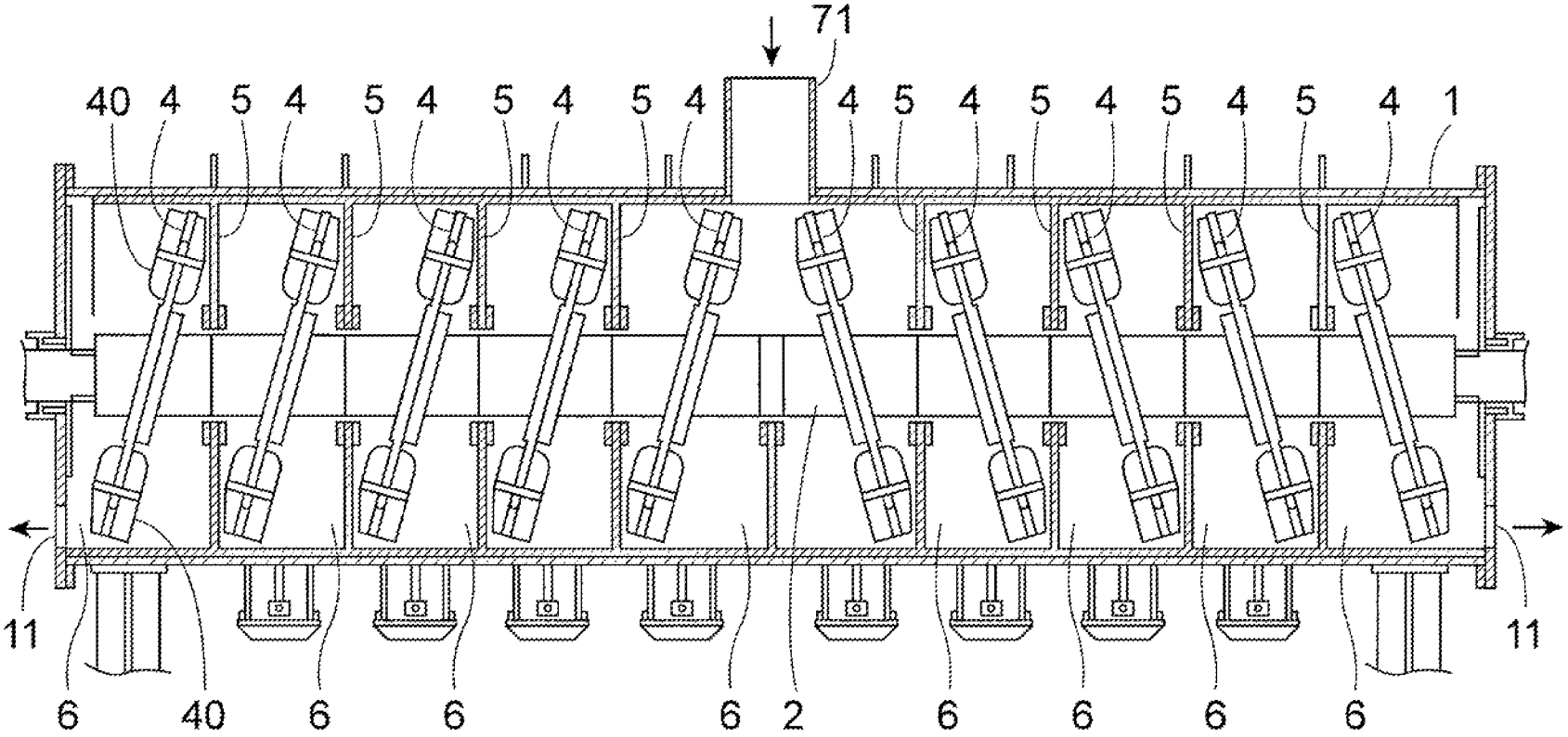
FIG. 17—It is a front and sectional view of the mill according to the third embodiment of the present invention.

FIG. 17 is a front and sectional view of a mill according to a third embodiment of the present invention. Hereinafter, a different configuration between the mill according to the third embodiment of the present invention and that of the mill according to the above-mentioned second embodiment (see FIG. 11) of the present invention will be mainly set forth. Same reference numbers are allotted to the same configurations as those of the mill of the above-mentioned second embodiment.

As in the case of the mill in the second embodiment, the mill of the third embodiment has a hopper (71) for putting in the to-be-milled material (raw material) above a central part of the drum body (1) in a longitudinal direction. And as in the case of the mill in the second embodiment, it has a hopper for discharge (21), a sieve member (22), and a motor (M) on right and left sides of the drum body (1), which is not shown in the figures.

A plurality of milling plates (4) are provided with predetermined spacing in a shaft direction of the central shaft (2) penetrating inside the drum body (1) and divide interior space of the drum body (1) into a plurality of milling chambers (6) in a shaft length direction. Each milling plate (4) is inclined with respect to the plane intersecting the central shaft (2) at a right angle, and rotates together with the central shaft (2). The milling plates (4) in a right half of the drum body (1) and those in a left half of the drum body (1) in a longitudinal direction are oppositely inclined with respect to each other. In FIG. 17, the milling plate (4) in the right half of the drum body (1) is inclined to a diagonally downward right direction and the milling plate (4) in the left half of the drum body (1) is inclined to a diagonally downward left direction. As in the case of the mill in the first embodiment, each milling chamber (6) has no milling media (a ball, etc.).

Figure 18:
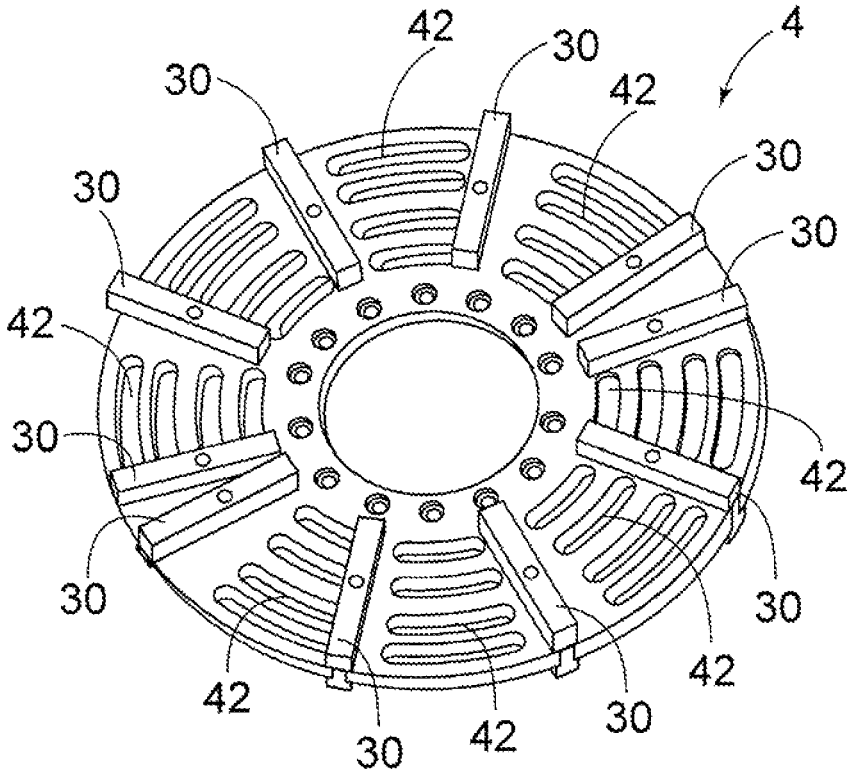
FIG. 18—It shows an example of the milling plate used in the mill according to the third embodiment of the present invention.

FIG. 18 illustrates an example of the milling plate (4) for use in the mill according to the third embodiment. The milling plate (4) consists of a circular (or an elliptical) plate having central holes in which the central shaft (2) is inserted and has a large number of through holes (42) consisting of elongate holes arranged substantially equally and substantially concentrically (or an elliptically concentric pattern) throughout the milling plate (4). The through holes (42) allow adjoining milling chambers (6) to be in communication with each other and are set sufficiently small so that only the to-be-milled material which was milled to less than a predetermined particle size can pass therethrough. Besides, the milling plate (4) in FIG. 20, which will be explained later, can be used in the mill according to the third embodiment.

A plurality of blocks (30) are attached to the milling plate (4) so as to protrude from both sides of the milling plate (4). The blocks (30) are attached to the milling plate (4) at substantially equal intervals along its periphery edge and extend towards a center of the milling plate (4) in areas between adjoining through holes (42) in peripheral directions. The blocks (30) can function to improve mill efficiency by contacting with to-be-milled materials. However, milling plates (4) without the blocks may be used in the third embodiment.

A plurality of pressure-receiving members (5) is placed in each milling chamber (6) and intersects the central shall (2) at right angles, respectively. The pressure-receiving member (5) is in a tabular shape so as to intersect the central shaft (2) at right angle, as in the case with the mill in the first embodiment (see FIG. 1). In this embodiment (third embodiment), use of such pressure-receiving member (5) in a tabular shape has advantages compared to the mill in the second embodiment (see FIG. 11) using as pressure-receiving member (5) having a piled-cone (truncated cone) structure or an abacus's bead shape as follows; First, a volume of to-be-milled materials to be contained in each milling chamber (6) increases due to increase of a volume in each milling chamber (6), resulting in an increase in processing efficiency. Second, since the pressure-receiving member (5) is relatively easy to be manufactured, manufacturing efficiency of the pressure-receiving member (5) increases, which is suitable for mass production.

Since the mills of the second and third embodiments have a hopper (71) for putting in the to-be-milled material (raw material) on a central part of the drum body (1) in a longitudinal direction, the to-be-milled materials taken inside the drum body (1) from the hopper (71) can be taken out separately from a discharge spout (11) provided on left and right ends after they are transported to rightward and leftward of the drum body (1), respectively and they are milled. Thus, mill efficiency with the mills of the second and third embodiments is twice as high as a mill transporting to-be-milled materials in only one direction from one end to the other end of the drum body.

Figure 19:
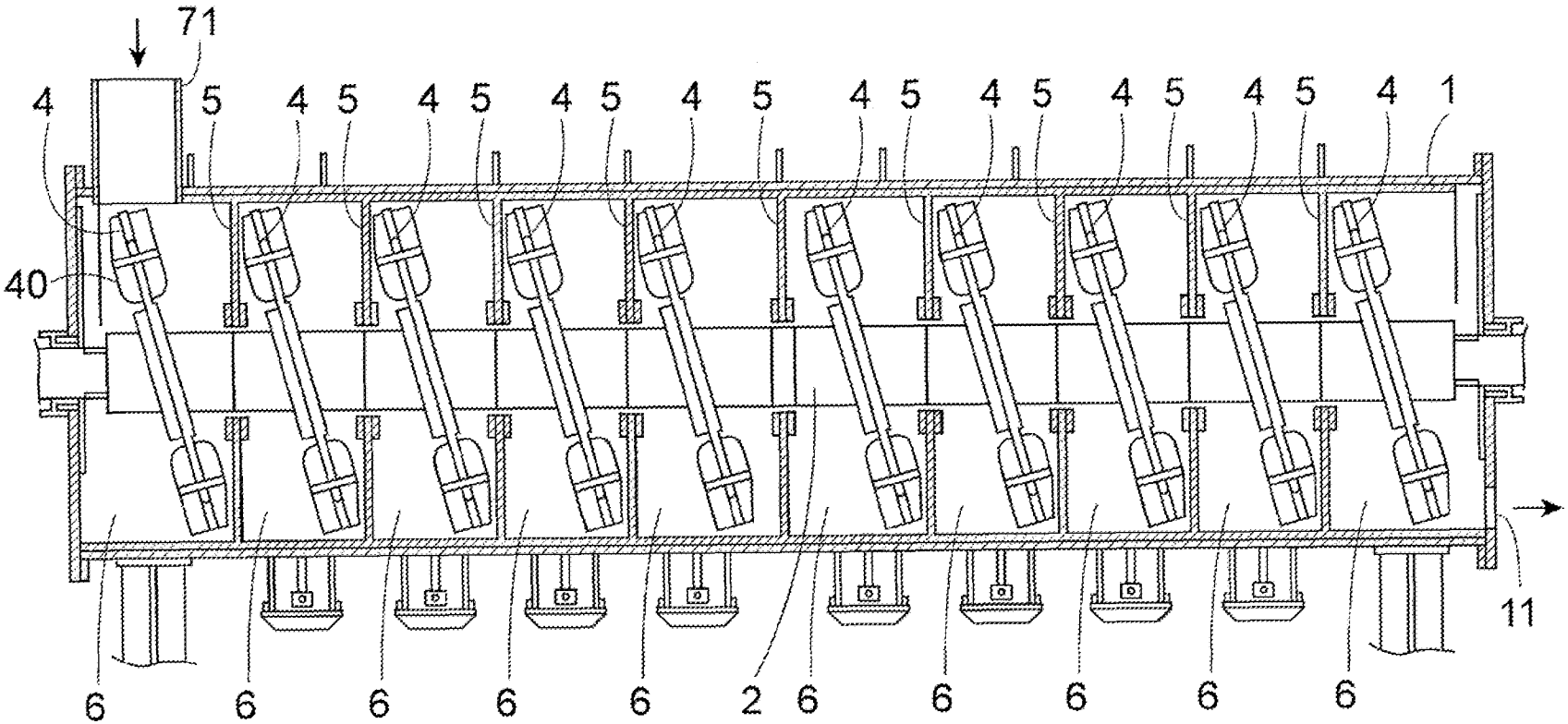
FIG. 19—It is a from and sectional view of the mill according to the fourth embodiment of the present invention.

FIG. 19 is a front and sectional view of a mill according to a fourth embodiment of the present invention. Hereinafter, a different configuration between the mill according to the fourth embodiment of the present invention and that of the mill according to the above mentioned third embodiment (see FIG. 17) of the present invention will be mainly set forth. Same reference numbers are allotted to the same configurations as those of the mill of the above-mentioned third embodiment.

The mill of the fourth embodiment has a hopper (71) for putting in the to-be-milled material (raw material) on one end of the drum body (1) in a longitudinal direction and a discharge spout (11) for taking the milled to-be-milled materials out of the drum body (1) on the other end of the drum body (1) in a longitudinal direction. Thus, in the mill of the fourth embodiment, as in the case of the mill in the first embodiment, to-be-milled materials are transferred in one direction from one end to the other end of the drum body (1) and taken out therefrom.

Figure 20:
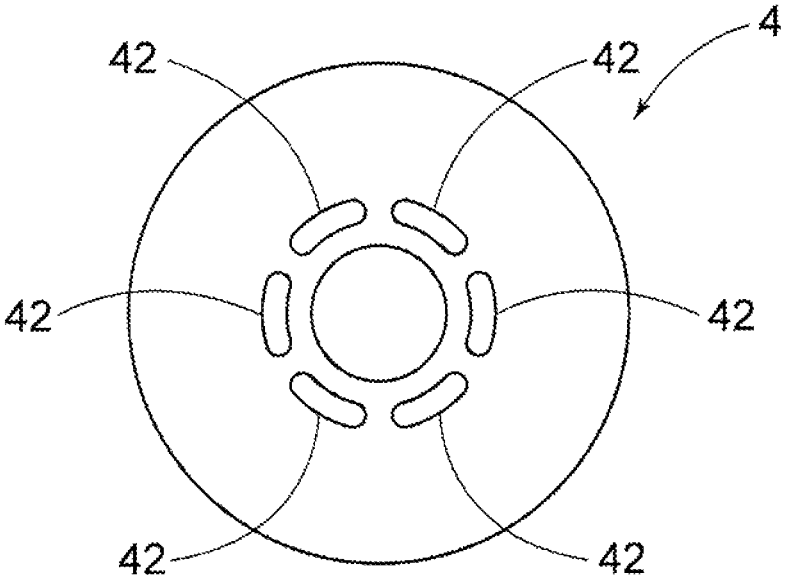
FIG. 20—It shows an example of the milling plate used in the mill according to the fourth embodiment of the present invention.

FIG. 20 illustrates an example of the milling plate (4) for use in the mill according to the fourth embodiment. The milling plate (4) consists of a circular (or an elliptical) plate having central holes in which the central shaft (2) is inserted. The milling plate (4) is provided with through holes (42) only in the vicinity of a central hole (that is, in the vicinity of the central shaft (2)). In particular, the milling plate (4) has a plurality of through holes (42) (6 holes in FIG. 20) aligned at certain intervals in a peripheral direction only in the vicinity of the central hole. It is preferable that the through holes (42) are specifically arranged only on an inner circular portion of the milling plate (4) whose radius is half of that of the milling plate (4), but it is not limited to this. The through holes (42) allow adjoining milling chambers (6) to be in communication with each other and are set sufficiently small so that only the to-be-milled material which was milled to less than a predetermined particle size can pass therethrough. Therefore, as in FIG. 20, if the through holes (42) are provided only in the vicinity of the central hole, milled to-be-milled materials is unlikely to pass through the through holes (42). As a result, residence time of the to-be-milled materials in each milling chamber increases, allowing foreign substances (mortars, etc.) adhered to surfaces of the to-be-milled materials (scrap materials of concrete, etc.) to be securely removed, thereby improving the quality of recycled aggregate to be reclaimed.

The milling plate (4) in FIG. 20 can be used in the mill in the above-mentioned first to third embodiments. Additionally, blocks (40) in FIG. 18 may be attached to the milling plate used in the mill in the fourth embodiment.

EXAMPLES

Hereinafter, the examples of the mill according to the present invention are shown in order to clarify effects of the present invention. However, the present invention is not limited to the following examples.

Manufacture of Recycled Fine Aggregate for Concretes

A milling process of concrete scrap materials (concrete shells) was conducted using the mill of the second embodiment (FIG. 11-FIG. 16), in order to study properties of the aggregate after the milling process. Results are shown in the following tables. As shown in the following tables, the aggregate after milling process satisfied the standard values of JIS in all test items.

TABLE 1

| Test items | Standard values | Test values |
|---|---|---|
| Face dry density (JIS A 1110) | — | 2.66 |
| Water absorption rate (JIS A 1110) | 3.0% or less | 1.25 |
| Absolute dry density (JIS A 1110) | 2.5 g/cm$^3$ or more | 2.63 |
| Particle quantity of aggregate (JIS A 1103) | 7.0% or less | 4.4 |
| Mass of unit volume (JIS A 5005) | — | 1.78 |
| Mass of unit volume for solid volume percentage for shape determination (JIS A 5005) | — | 1.50 |
| Solid volume percentage for shape determination (JIS A 5005) | 55% or more | 57.0 |
| Alkali silica reaction test (Rapid method JIS A 1804-2009) | — | Determined as harmless |

TABLE 2

| Sieve analysis test (JIS A 1102) | | | |
|---|---|---|---|
| Sieve opening (mm) | Cumulative residual mass (g) | Residual percentage (%) | Percentage passing (%) |
| 10 | 0 | 0.0 | 100.0 |
| 5 | 0 | 0.0 | 100.0 |
| 2.5 | 150 | 28.8 | 71.2 |
| 1.2 | 260 | 49.7 | 50.3 |
| 0.6 | 341 | 65.3 | 34.7 |
| 0.3 | 429 | 82.0 | 18.0 |
| 0.15 | 510 | 97.6 | 2.4 |
| Total | 521 | 100.0 | |
| Fineness modulus | | 3.24 | |

INDUSTRIAL APPLICABILITY

The mill according to the present invention is used, for example, to obtain a recycled aggregate from concrete scrap materials or asphalt scrap materials, or to process soft stones included in natural aggregates.

EXPLANATION OF REFERENCE NUMBERS a To-be-milled material
b Water
1 Drum body
2 Central shaft
22 Sieve member
4 Milling plate
41 Central hole.
42 Through hole
44 Surface of a milling plate
45 Surface of a milling plate
5 Pressure-receiving member
50 Semidisc part
51 Inner periphery edge
52 Through hole
54 Flange part
51B Inclined plane
6 Milling chamber
8 First delivery device
81 First conveyor device
9 Second delivery device
91 Second conveyor device
10 Mechanism for changing a discharge spout area
11 Discharge spout of the drum body
α Inclined angle with respect to a plane intersecting at right angle to a central shall of the inclined plane
β Inclined angle with respect to a plane intersecting at right angle to a central shaft of the milling plate

What is claimed is:

1. A mill comprising a cylindrical drum body configured so that material to be milled is taken in through a hopper for the mill and milled material is discharged from a drum outlet, a central rotating shaft penetrating said drum body in a longitudinal direction, a plurality of milling plates that are attached to the central rotating shaft with predetermined spacing in the longitudinal direction of said central rotating shaft, and divide interior space of said drum body into a plurality of milling chambers, and wherein the mill does not comprise a milling media which mills material by contacting said materials therewith while moving by rolling in said drum body, a plurality of pressure receiving members, each pressure receiving member being attached to the drum body, located in a respective milling chamber and facing each of the milling plates defining the respective milling chamber, wherein each pressure receiving member having a plurality of holes that allow for the passage of material being milled;

wherein the milling plates are inclined with respect to a plane intersecting the central rotating shaft at a right angle, and further wherein the rotating milling plates mill the material against the pressure receiving members in the milling chambers, and move the material sequentially through the pressure receiving members from the hopper to the drum outlet.

2. The mill according to claim 1, wherein said milling plate is provided with a plurality of through holes which said material being milled can pass through.

3. The mill according to claim 2, wherein said through holes are provided only in the vicinity of said central shaft.

4. The mill according to claim 1, wherein the plurality of through holes present in the pressure receiving members, which allow the passage of material being milled, gradually decrease in size from the upstream side of the drum body towards the downstream side of the drum body.

5. The mill according to claim 1, wherein the surface of at least any one of said milling plates has concave-convex knobs.

6. The mill according to claim 1, wherein said milling plates have wavy curved-surface structures where peaks and valleys are iteratively provided at certain spacing in a circumference direction.

7. The mill according to claim 1, wherein the hopper for putting the to-be-milled material into the drum body is provided on a central part of the drum body in the longitudinal direction, wherein a drum outlet and discharge spout for discharging milled material from said drum body is provided on both ends of the drum body in the longitudinal direction, wherein said milling plates are attached and inclined with respect to a plane intersecting said central shaft at a right angle and rotate with said central shaft, and wherein said milling plates on one side of the hopper are oppositely inclined with respect to the milling plates on the other side of the hopper.

8. The mill according to claim 1, wherein a discharge spout for discharging milled material from said drum body is provided with a mechanism for changing the size of said discharge spout.

9. The mill according to claim 1, comprising at least one sieve member which is attached to said drum outlet of said drum body and sorts milled material discharged from said drum body into several grades.

10. The mill according to claim 9, wherein further comprising at least one conveyor devices for carrying milled material sorted by the sieve member.

* * * * *